US009016037B2

(12) United States Patent
Herman

(10) Patent No.: US 9,016,037 B2
(45) Date of Patent: Apr. 28, 2015

(54) CONTAINER HAVING A DISSOLVABLE DISPENSE INDICATOR

(71) Applicant: Owens-Brockway Glass Container Inc., Perrysburg, OH (US)

(72) Inventor: Megan Herman, Toledo, OH (US)

( * ) Notice: Subject to any disclaimer, the term of this patent is extended or adjusted under 35 U.S.C. 154(b) by 341 days.

(21) Appl. No.: 13/666,488

(22) Filed: Nov. 1, 2012

(65) Prior Publication Data

US 2014/0116009 A1 May 1, 2014

(51) Int. Cl.

| | |
|---|---|
| ***B65D 23/02*** | (2006.01) |
| ***B65D 55/02*** | (2006.01) |
| ***B65D 49/00*** | (2006.01) |
| ***B67B 1/06*** | (2006.01) |

(52) U.S. Cl.

CPC . *B65D 23/02* (2013.01); *B67B 1/06* (2013.01); *B65D 2101/00* (2013.01); *B65D 2203/12* (2013.01)

(58) Field of Classification Search

CPC ..... B67B 1/06; B65D 49/12; B65D 49/00; B65D 55/066; B65D 55/026; B65D 2501/24872; B65D 2203/00; B65D 2101/0084; B65D 90/48; B65D 83/757; B65D 83/224; B65D 51/245; B65D 23/02; B65D 23/008; B65D 23/006

USPC ..... 53/471, 492; 116/200; 206/459.1, 206/459.5; 215/364, 366; 222/23, 147, 154

See application file for complete search history.

(56) References Cited

U.S. PATENT DOCUMENTS

| | | | | | |
|---|---|---|---|---|---|
| 489,965 | A | * | 1/1893 | Leith | 215/14 |
| 578,320 | A | * | 3/1897 | Fawcett | 215/366 |
| 580,830 | A | * | 4/1897 | McGrath | 215/17 |
| 591,724 | A | * | 10/1897 | Barrett | 215/366 |
| 808,280 | A | * | 12/1905 | Genella | 215/366 |
| 874,393 | A | * | 12/1907 | Collins | 215/366 |
| 1,228,832 | A | * | 6/1917 | Schmidt | 215/230 |
| 1,245,386 | A | * | 11/1917 | Sackett | 206/459.1 |
| 1,326,974 | A | * | 1/1920 | Schmidt | 215/230 |
| 1,638,199 | A | * | 8/1927 | Hermes | 215/366 |
| 2,024,996 | A | | 12/1935 | De Florez | |
| 2,025,498 | A | * | 12/1935 | Desmond | 215/230 |
| 2,042,996 | A | * | 6/1936 | John | 222/23 |
| 2,062,897 | A | | 12/1936 | Michel et al. | |
| 3,151,426 | A | * | 10/1964 | Pechmann | 53/487 |
| 3,399,811 | A | | 9/1968 | Miller | |
| 3,704,813 | A | * | 12/1972 | Devol | 222/147 |
| 3,899,295 | A | * | 8/1975 | Halpern | 206/459.1 |
| 4,511,052 | A | * | 4/1985 | Klein et al. | 116/200 |

(Continued)

FOREIGN PATENT DOCUMENTS

| | | | | |
|---|---|---|---|---|
| FR | 347756 | | 3/1905 | |
| FR | 347756 | A * | 3/1905 | B65D 49/00 |

(Continued)

OTHER PUBLICATIONS

PCT Search Report and Written Opinion, Serial No. PCT/US2013/063195 Filing Date: Oct. 3, 2013, Applicant: Owens-Brockway Glass Container Inc., Mail Date: Nov. 28, 2013, 9 pages.

(Continued)

*Primary Examiner* — Stephen F Gerrity

(57) ABSTRACT

A product includes a dissolvable dispense indicator carried by a container.

19 Claims, 4 Drawing Sheets

(56) References Cited

U.S. PATENT DOCUMENTS

| | | | | |
|---|---|---|---|---|
| 4,526,752 | A * | 7/1985 | Perlman et al. | 206/459.1 |
| 4,712,700 | A * | 12/1987 | Fischman | 215/366 |
| 4,755,405 | A * | 7/1988 | Massucco et al. | 206/459.1 |
| 4,816,305 | A * | 3/1989 | Stillwell et al. | 206/459.1 |
| 4,967,687 | A | 11/1990 | McShane | |
| 4,986,429 | A * | 1/1991 | Singleton, Jr. | 206/459.1 |
| 5,879,699 | A * | 3/1999 | Lerner | 424/440 |
| 6,223,937 | B1 * | 5/2001 | Schmidt | 215/364 |
| 6,230,937 | B1 * | 5/2001 | Johnson et al. | 222/147 |
| 6,378,906 | B1 * | 4/2002 | Pennaz | 206/459.1 |
| 2002/0012689 | A1 * | 1/2002 | Stillman | 424/439 |
| 2002/0195413 | A1 * | 12/2002 | Eastman et al. | 206/459.1 |
| 2004/0054332 | A1 * | 3/2004 | Ferguson | 604/220 |
| 2007/0023300 | A1 | 2/2007 | Spector et al. | |
| 2008/0041751 | A1 * | 2/2008 | Catalfamo | 206/459.1 |
| 2012/0017766 | A1 | 1/2012 | Anson et al. | |
| 2012/0103850 | A1 * | 5/2012 | Onda | 206/459.1 |
| 2013/0125808 | A1 * | 5/2013 | Sternberg et al. | 116/200 |

FOREIGN PATENT DOCUMENTS

| | | | | |
|---|---|---|---|---|
| FR | 367152 | A * | 10/1906 | B65D 49/00 |
| GB | 191215453 | A * | 0/1912 | B65D 23/008 |
| GB | 2408042 | | 5/2005 | |

OTHER PUBLICATIONS

PCT Written Opinion of the Preliminary Examining Authority, Int. Serial No. PCT/US2013/63195, Int. Filing Date: Oct. 3, 2013, Applicant: Owens-Brockway Glass Container Inc., Mail Date: Dec. 12, 2014, 6 pages.

* cited by examiner

CONTAINER HAVING A DISSOLVABLE DISPENSE INDICATOR

The present disclosure is directed to containers and, more particularly, to containers having anti-counterfeit features.

BACKGROUND AND SUMMARY OF THE DISCLOSURE

Many containers are provided with tamper-resistant devices to resist refilling of contents in the containers. For example, a beverage container can include a fitment that renders the container non-refillable, so as to impede efforts to refill the container with inferior products. U.S. Pat. No. 3,399,811 illustrates a container of this type.

A general object of the present disclosure, in accordance with one aspect of the disclosure, is to provide a product including a dispense indicator carried by a container to indicate when original product has been dispensed from the container and, thus, to provide evidence of efforts to repackage the container with counterfeit product.

The present disclosure embodies a number of aspects that can be implemented separately from or in combination with each other.

A product in accordance with one aspect of the disclosure includes a container to hold an original product, and a dissolvable dispense indicator carried by the container.

In accordance with a further aspect of the disclosure, there is provided a package for containing a liquid, and including a container having a finish with at least one internal thread segment, and a closure with at least one external thread segment for removable threaded insertion into the finish to capture the liquid within the container. The internal thread segment on the finish is constructed of a material that dissolves upon contact with the liquid so that, upon removal of the closure and dispensing of the liquid through the finish, the internal thread segment is dissolved and the closure cannot be re-secured to the container.

In accordance with another aspect of the disclosure, there is provided a method of producing a product that includes coupling a dissolvable dispense indicator to an internal surface of a neck of a container, filling the container with an original flowable product, and closing the container with a closure.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
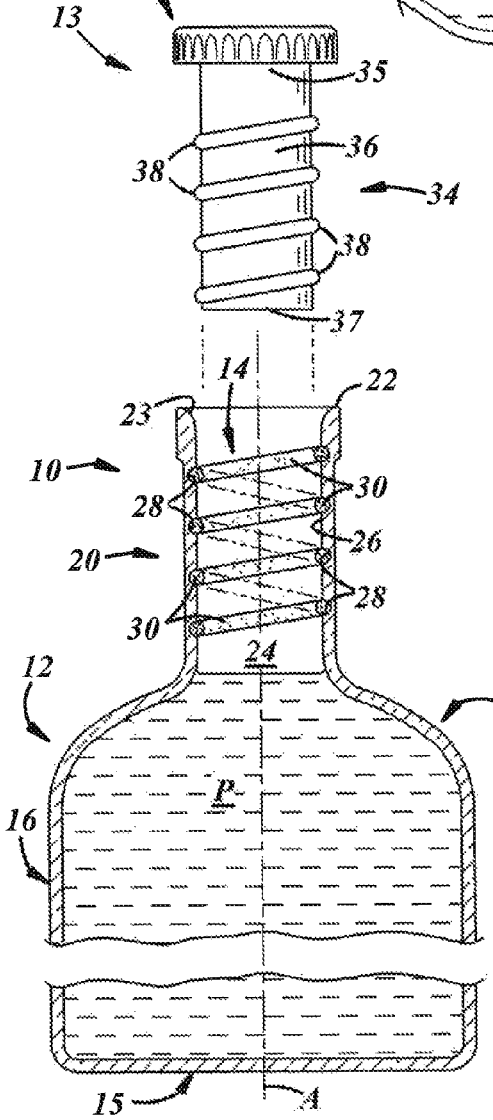
FIG. 1 is an exploded, fragmentary, sectional, elevational view of a package in accordance with an illustrative embodiment of the present disclosure and including a closure, a container filled with a product, and a dispense indicator carried by the container and shown in a first or intact state.

FIG. 1 illustrates a package 10 in accordance with an illustrative embodiment of the disclosure as including a container 12, a closure 13 for the container 12, an original material or product P filling the container 12, and an indicator 14 carried by the container 12. The indicator 14 facilitates evidencing of efforts to tamper with the package 10, by being dissolvable so as to irreversibly change a visual characteristic visible from outside the container 12. In other words, the indicator 14 provides a counterfeit deterrence feature that provides evidence that an original package has been opened and product dispensed therefrom, such that a purchaser can see that the container 12 has been "used" after the container 12 was originally packaged with the product P carried therein and the closure 13 coupled thereto. For example, the package 10 may be opened and then partially or completely emptied of its original product P. Thereafter, if counterfeiters attempt to refill the emptied container 12 with counterfeit product and repackage the package 10 with the closure 13 (with or without closure seals or the like), the indicator 14 will be visibly partially or completely dissolved, as evidence that the package 10 is not original and, instead, has been refilled and repackaged. In other words, the package 10 is permanently or irreversibly identifiable as being a once-fillable package. Over time, purchasers will become educated to spot refilled counterfeit packages. Thus, counterfeiters will be deterred from offering counterfeit packages to such educated purchasers.

The container 12 may be of one-piece integrally formed construction, for example, glass or plastic construction. (The term "integrally formed construction" does not exclude one-piece integrally molded layered glass constructions of the type disclosed for example in U.S. Pat. No. 4,740,401, or one-piece glass bottles to which other structure is added after the bottle-forming operation.) The container 12 may be fabricated in press-and-blow (including narrow neck press-and-blow) or blow-and-blow glass container manufacturing operations, or in a plastic injection and/or blow molding operation, or in any other suitable manner.

The container 12 may be of any suitable shape, and may include a jug, jar, bottle, other food or beverage container, or any other suitable container. The container 12 may include a base 15 on which the container 12 may be supported, a body 16 extending axially from the base 15, a shoulder 18 extending radially and axially from the body 16, and a neck 20 extending axially from the shoulder 18. As used herein, the term axial includes oriented generally along a longitudinal axis of the closure, container, or package and may include but is not limited to a direction that is strictly parallel to a container longitudinal central axis A. The body 16 and the neck 20 may be generally cylindrical, as illustrated, or they may be tapered or of any other suitable shape. The neck 20 may include an axial outward end surface or lip 22, an open mouth 23, an interior 24, and an interior surface 26. The neck 20 also may include a finish, which may include one or more internal thread segment(s) 28 for coupling to the closure 13. As used herein, the term thread segment includes whole, partial, multiple, and/or an interrupted thread and/or thread segment. The thread segment(s) 28 may be formed, machined, or otherwise provided in the interior surface 26 of the neck 20. In another embodiment, the neck 20 may include a smooth cylindrical interior surface 26 without thread segments provided therein.

Still referring to FIG. 1, the indicator 14 may include any suitable components and may be carried in any suitable location(s) of the container neck 20. For example, as shown in the illustrated embodiment, the indicator 14 may include one or more thread segments 30. In one embodiment, the segments 30 may be carried in the corresponding thread segment(s) 28 of the container neck 20. In another embodiment, the indicator 14 including the segments 30 may be pre-formed separately from the container 12 and then press fit or interference fit in the smooth cylindrical surface of the container neck 20. Also, detents or other engagement elements could be used to hold the segments 30 in the container 12. In other embodiments, the indicator 14 may be three-dimensionally printed on the inside surface of the container neck 20. In the illustrated embodiment, the thread segments 30 may be assembled to the container 12 by threading the thread segments 30 into the container thread segment(s) 28, by forming the segments 30 in situ in the container thread segments, or in any other suitable manner.

In any case, the indicator 14 is responsive to dispensing of the product P out of the container 12. For instance, the indicator 14 partially or completely dissolves when the product P flows from the body 16, through the neck 20 and over the indicator 14, and out of the container mouth 23. The indicator 14 may be composed on or more of the following materials: sugar; coloring; flavoring; tasteless material; citric acid; salt; gelatin; polyhedric alcohol, for instance, sorbitol, zilotrol, or the like; corn syrup; starch; natural gums, for instance, gum arable, or the like; or any other suitable material(s), which, for example, may be approved by the U.S. Food & Drug Administration. Accordingly, the indicator 14 may provide a means to add flavoring or coloring to a beverage or food product during dispensing.

The closure 13 may include a base or cover 32 for covering the lip 22 of the container neck 20, and a body or plug 34 extending axially from the cover 32 for coupling to the interior 24 of the neck 20. The plug 34 may include a fixed end 35 extending from the cover 32, a free end 37 opposite the fixed end 35, and one or more thread segments 38 disposed therebetween for cooperating with the thread segments 30 of the indicator 14. In other embodiments, the closure 13 may include any other suitable structure which may be fastened to the neck 20 of the container 12 in any other suitable manner.

The original product P may include an authentic or genuine brand name product, that is dispensably disposed within the container 12 of the package 10, for instance, at a packaging or bottling plant of a product manufacturer. More specifically, the product manufacturer may fill the container 12 with the original product P at the packaging plant, for example, through a fill tube extending down into the body 16 to avoid splashing the indicator 14 with the product P. Thereafter, the manufacturer may close the container 12 with the closure 13, for example, by interengaging the closure thread segments 38 with the indicator thread segments 30, and may be sealed thereto with wax, paper or plastic seal, or any other suitable seal (none shown). Thereafter, during initial use, the closure 13 may be removed and the product P dispensed out of the container 12 through the neck 20. The closure 13 may include a cap, cork, plug, or any other suitable type of closure. The product P may include a liquid, or solid product that is flowable at room temperature, for example, a beverage, for instance, beer, wine, liquor, soda, or any other suitable beverage or liquid, or a food of any kind. Prior to filling of the container 12 with the product P, the indicator 14 is in an intact or undissolved state.

Figure 2:
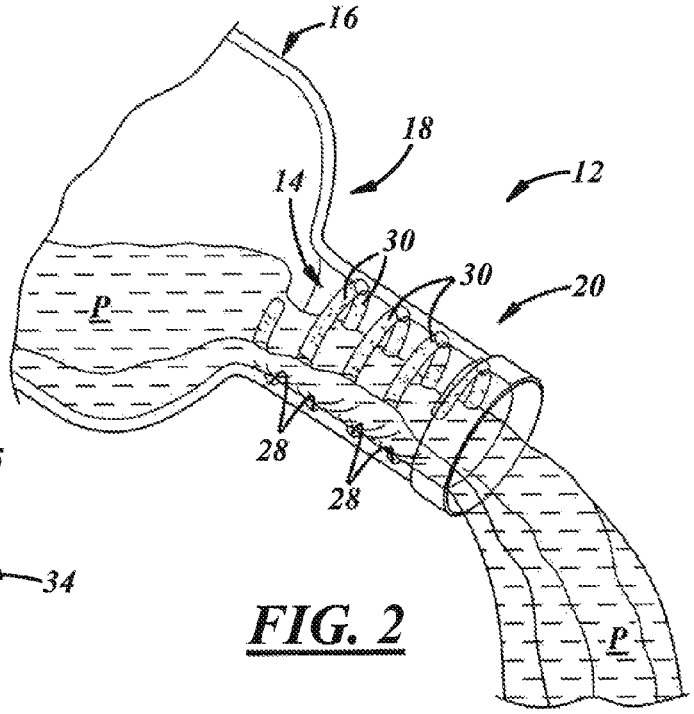
FIG. 2 is a fragmentary perspective view of the package of FIG. 1, excluding the closure, being relieved of some of the product of FIG. 1, and with the dispense indicator of FIG. 1 shown in a partially dissolved state responsive to dispensing of the product.

But, with reference to FIG. 2, after opening of the package 10 (FIG. 1) by closure removal, and during dispensing of the original product P out of the container 12, the indicator 14 is adapted to at least partially dissolve to provide an irreversible visual indication or characteristic that is visible from outside of the container 12 to indicate to a user that at least some of the original product P has been dispensed from the container 12. Accordingly, the indicator 14 will exhibit a second state of the visual characteristic that is different from the first state of the visual characteristic. The terminology "irreversible" includes a manner in which the indicator 14 is, by design-intent, modifiable in one direction, for example, from intact to dissolved or partially dissolved but not back to intact. In FIG. 2, the indicator 14 is shown in a partially dissolved state. Accordingly, the closure cannot be re-secured or re-threaded to the container 12, but may be sealable thereto by axial sealing engagement of the cover 32 with the lip 22.

Figure 4:
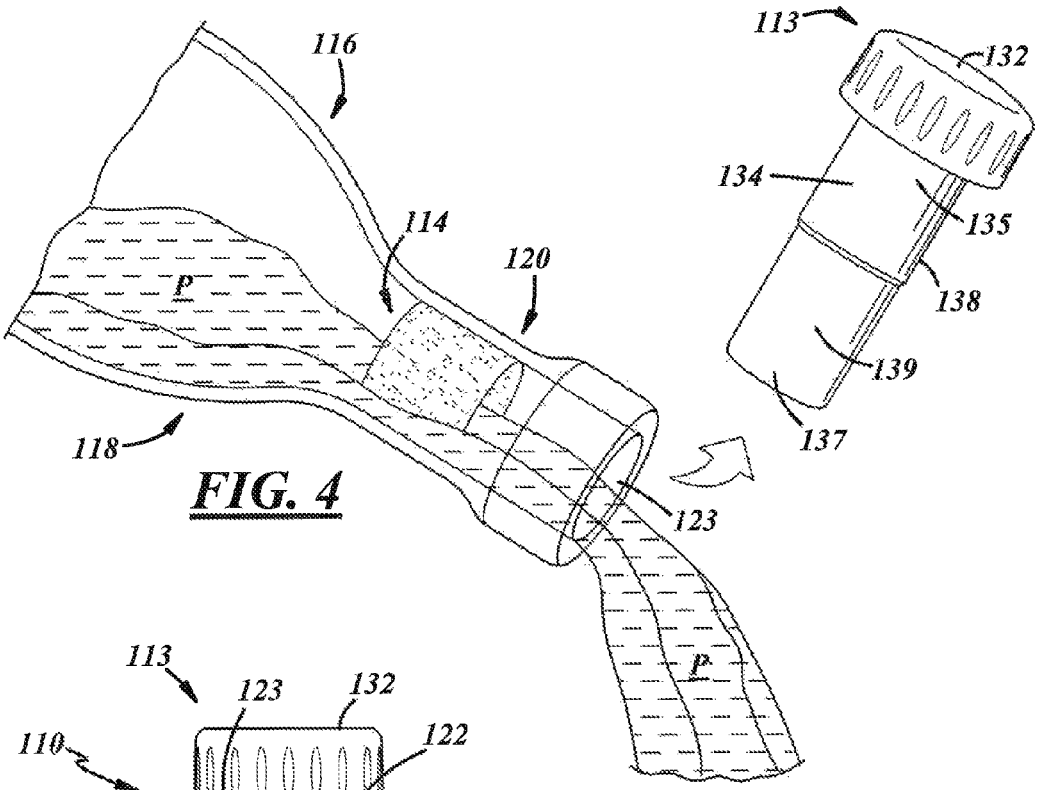
FIG. 4 is a fragmentary exploded view of the package of FIG. 3, with the closure removed, and the container being relieved of some product contained therein, and with the dispense indicator of FIG. 3 shown in a partially dissolved state responsive to dispensing of the product.
Figure 3:
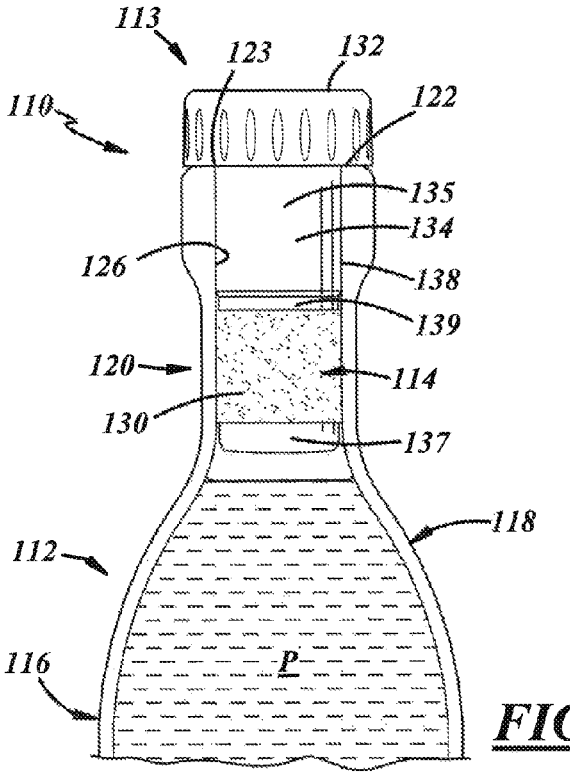
FIG. 3 is a fragmentary perspective view of a package in accordance with another illustrative embodiment of the present disclosure and including a closure, a container, and a dispense indicator carried by the container and shown in a first or intact state.
Figure 5:
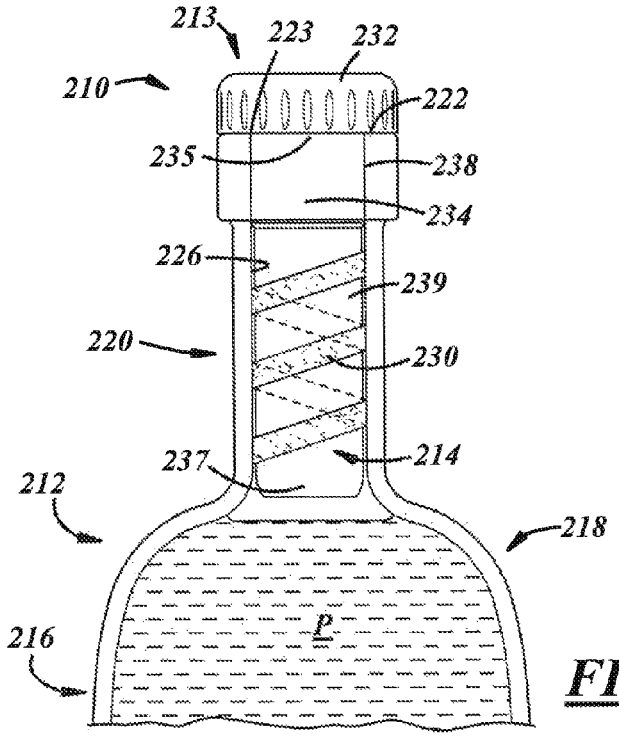
FIG. 5 is a fragmentary perspective view of a package in accordance with a further illustrative embodiment of the present disclosure and including a closure, a container, and a dispense indicator carried by the container and shown in a first or intact state.

FIGS. 4-5 illustrate another illustrative embodiment of a package 110. This embodiment is similar in many respects to the embodiment of FIGS. 1-3 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The package 110 includes a container 112, a closure 113 for the container 112, an original material or product P filling the container 112, and a dissolvable indicator 114 carried by the container 112. The container 112 may include a body 116, a shoulder 118 extending radially and axially from the body 116, and a neck 120 extending axially from the shoulder 118. The neck 120 may include an axial outward end surface or lip 122, a mouth 123, an interior, and an interior surface 126 that may be smooth and cylindrical.

The closure 113 may include a base or cover 132 for covering the lip 122 of the container neck 120, and a body or plug 134 extending axially from the cover 132 for coupling to the interior 124 of the neck 120. The plug 134 may include a fixed end 135 extending from the cover 132, a free end 137 opposite the fixed end 135, and a sealing diameter 138 that may seal with a corresponding portion of the internal surface 126 of the container neck 120. Also, the cover 132 may sealingly engage the lip 122.

The indicator 114 may include a ring or annular band 130 having an external surface in contact with a corresponding portion of the interior surface 126 of the container neck 120, and an internal surface slightly greater in diameter than a corresponding portion of a reduced diameter 139 of the closure plug 134. In any case, the container neck 120, the plug 134, and the indicator 114 may be sized so that the sealing diameter 138 of the plug 134 seals with the container neck 120 but does not interfere with the indicator 114.

As shown in FIG. 4, the indicator 114 is responsive to dispensing of product out of the container 112. For instance, the indicator 114 partially or completely dissolves when the product P flows from the body 116, over the shoulder 118, through the neck 120 and over the indicator 114, and out of the container mouth 123.

Figure 6:
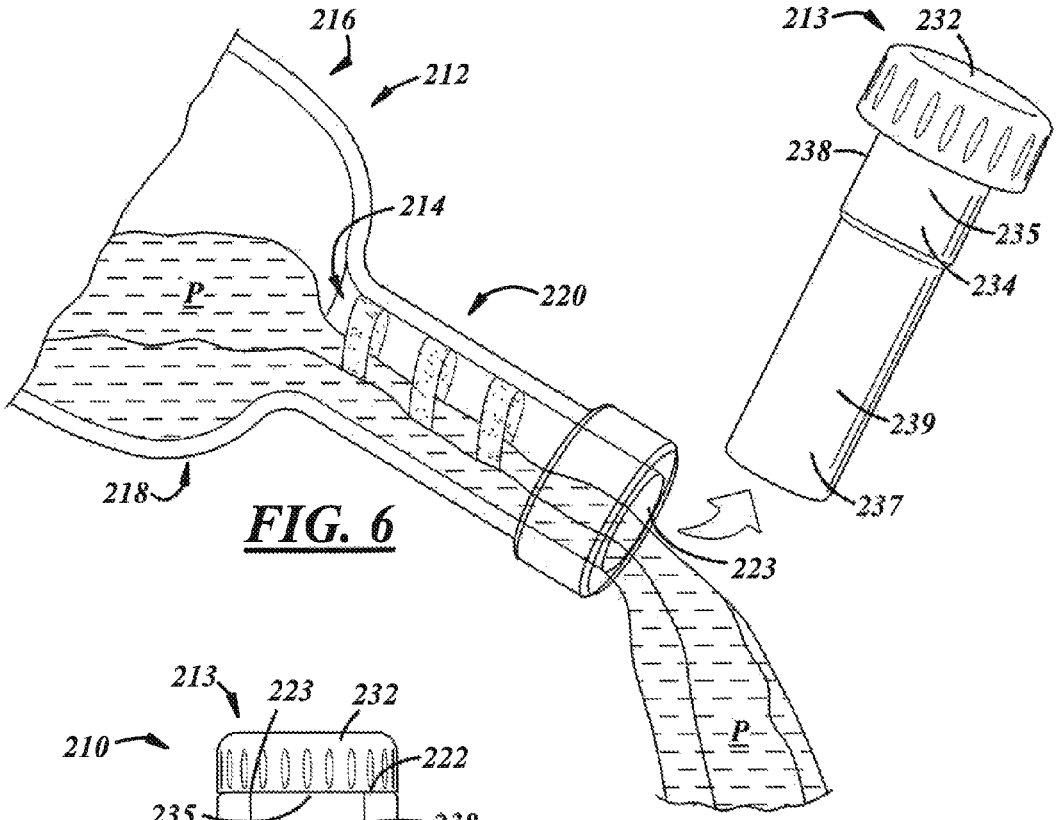
FIG. 6 is a fragmentary exploded view of the package of FIG. 5, with the closure removed, and the container being relieved of some product contained therein, and with the dispense indicator of FIG. 5 shown in a partially dissolved state responsive to dispensing of the product.

FIGS. 5-6 illustrate another illustrative embodiment of a package 210. This embodiment is similar in many respects to the embodiment of FIGS. 1-4 and like numerals between the embodiments generally designate like or corresponding elements throughout the several views of the drawing figures. Accordingly, the descriptions of the embodiments are incorporated into one another. Additionally, the description of the common subject matter generally may not be repeated here.

The package 210 includes a container 212, a closure 213 for the container 212, an original material or product P filling the container 212, and a dissolvable indicator 214 carried by the container 212. The container 212 may include a body 216, a shoulder 218 extending radially and axially from the body 216, and a neck 220 extending axially from the shoulder 218. The neck 220 may include an axial outward end surface or lip 222, an open mouth 223, an interior, and an interior surface 226.

The closure 213 may include a base or cover 232 for covering the lip 222 of the container neck 220, and a body or plug 234 extending axially from the cover 232 for coupling to the interior 224 of the neck 220. The plug 234 may include a fixed end 235 extending from the cover 232, a free end 237 opposite the fixed end 235, and a sealing diameter 238 that may seal with a corresponding portion of the internal surface 226 of the container neck 220. Also, the cover 232 may sealingly engage the lip 222.

The container neck 220, the plug 234, and the indicator 214 may be sized so that the sealing diameter 238 of the plug 234 seals with the container neck 220 but does not interfere with the indicator 214. For example, the indicator 214 may include a helix 230 having an external surface in contact with the interior surface 226 of the container neck 220, and an internal surface slightly greater in diameter than a corresponding outer diameter of the closure plug 234.

As shown in FIG. 6, the indicator 214 is responsive to dispensing of product out of the container 212. For instance, the indicator 214 partially or completely dissolves when the product P flows from the body 216, over the shoulder 218, through the neck 220 and over the indicator 214, and out of the container mouth 223.

Figure 7:
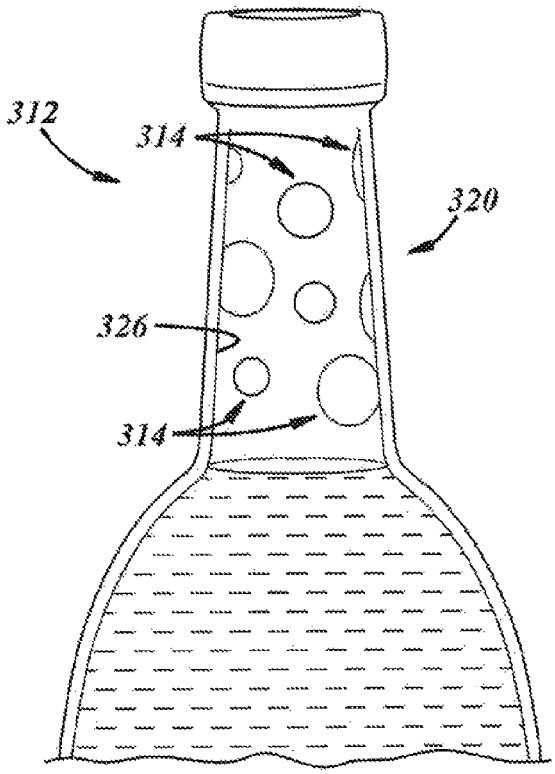
FIG. 7 is a fragmentary perspective view of a container in accordance with an illustrative embodiment of the present disclosure and including a decorative dispense indicator carried by the container and shown in an intact state.
Figure 8:
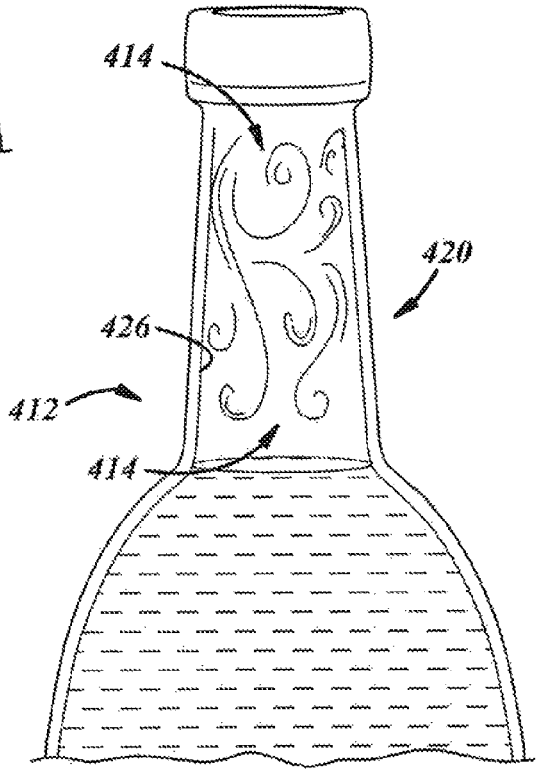
FIG. 8 is a fragmentary perspective view of a container in accordance with another illustrative embodiment of the present disclosure and including another decorative dispense indicator carried by the container and shown in art intact state.

FIGS. 7 and 8 illustrate additional illustrative embodiments of containers 312, 412. These embodiments are similar in many respects to the embodiments of FIGS. 1-6 and like numerals between the embodiments generally designate like or corresponding elements throughout the several views of the drawing figures. Accordingly, the descriptions of the embodiments are incorporated into one another. Additionally, the description of the common subject matter generally may not be repeated here.

Referring to FIG. 7, the container 312 includes a neck 320 having an indicator 314 that is carried on an internal surface 326 of the neck 320 and that is also decorative. The indicator 314 may include a plurality of decorative geometric shapes, like circles, as illustrated. Referring to FIG. 8, the container 412 includes a neck 420 having a decorative indicator 414 carried on an internal surface 426 of the neck 420. The indicator 414 may include a plurality of decorative lines, for example, including artistic designs. In other embodiments, the shapes or designs of the decorative indicators 314, 414 may include brand logos, brand names, slogans, or the like.

According to other embodiments of the present disclosure, there are provided methods of producing and using a product. The method of producing a product includes coupling a dissolvable dispense indicator to a container, filling the container with an original product, and closing the container with a closure. The filling step may include using a fill tube extending down past, the indicator to avoid splashing the indicator with the product. The method of using that product includes removing the closure from the container and dispensing at least some of the original product, wherein flow of the product over the indicator at least partially dissolves the indicator.

There thus has been disclosed a dissolvable dispense indicator carried by a container and that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the an in view of the foregoing discussion. The disclosure is intended to embrace all such modifications and variations as fail within the spirit and broad scope of the appended claims.

The invention claimed is:

1. A package comprising:

a product that includes:

a container to hold an original product wherein the container is a bottle including a central longitudinal axis, a base, a body extending from the base, a shoulder extending from the body, and a neck extending from the shoulder and having an internal surface; and a dissolvable dispense indicator carried by the internal surface of the neck of the container;

an original flowable product dispensably disposed within the container; and a closure coupled to the container and including a plug having a free end extending axially beyond the indicator along a direction into the container.

2. The product set forth in claim 1 wherein the dissolvable dispense indicator is in an intact state but, during dispensing of the original product, the indicator at least partially dissolves to provide an irreversible visual indication that is visible externally of the container to indicate that the original product has been at least partially dispensed from the container.

3. The product set forth in claim 1 wherein the indicator is an annular band.

4. The product set forth in claim 1 wherein the indicator is a helix.

5. The product set forth in claim 1 wherein the indicator is also decorative.

6. The product set forth in claim 1 wherein the indicator is composed of at least one of sugar, coloring, flavoring, tasteless material, citric acid, salt, gelatin, polyhedric alcohol, corn syrup, starch, or natural gum.

7. The package of claim 1, wherein the closure plug has a sealing diameter sealed to a corresponding portion of the internal surface of the container neck and having a reduced diameter corresponding to the indicator.

8. The package of claim 1, wherein the indicator circumscribes a portion of the closure plug.

9. A product that includes:

a container to hold an original product; and a dissolvable dispense indicator carried by the container, wherein the indicator includes a thread segment carried inside the container.

10. A product that includes:

a container to hold an original product; and a dissolvable dispense indicator carried by the container, wherein the container includes a neck having an internal thread segment, and the indicator includes a thread segment carried in the internal thread segment of the container.

11. A package comprising:

a product including:

a container to hold an original product; and a dissolvable dispense indicator carried by the container, an original flowable product dispensably disposed within the container; and a closure coupled to the container, wherein the container includes a neck having an internal thread segment, and the indicator includes an indicator thread segment carried in the internal thread segment of the container, wherein the closure includes a closure thread segment threaded to the indicator thread segment to couple the closure to the container.

12. The package set forth in claim 11 wherein the indicator includes at least one internal thread segment, for removable threaded engagement with the closure thread segment to capture the original flowable product within the container, and wherein the indicator thread segment is constructed of a material that dissolves upon contact with the flowable product so that, upon removal of the closure and dispensing of the original flowable product through the neck, the internal thread segment is dissolved and the closure cannot be re-threaded to the container.

13. A package for containing a flowable product, which includes:

a container having a finish with at least one internal thread segment, and a closure with at least one external thread segment for removable threaded insertion into said finish to capture said flowable product within said container, characterized in that said internal thread segment on said finish is constructed of a material that dissolves upon contact with said flowable product so that, upon removal of said closure and dispensing of the flowable product through the finish, said internal thread segment is dissolved and said closure cannot be re-secured to said container.

14. The product set forth in claim 13 wherein the internal thread segment is composed of at least one of sugar, coloring, flavoring, tasteless material, citric acid, salt, gelatin, polyhedric alcohol, corn syrup, starch, or natural gum.

15. A method of producing a product that includes:

(a) applying a dissolvable dispense indicator to an internal surface of a neck of a container;

(b) filling the container with an original flowable product; and (c) closing the container with a closure so that a free end of a plug of the closure extends axially beyond the indicator along a direction into the container.

16. A product produced by the method of claim 15.

17. A method of using the product of claim 16, including removing the closure from the container and dispensing at least some of the original product, wherein the indicator at least partially dissolves to provide an irreversible visual indication that is visible externally of the container to indicate that at least some of the original flowable product has been dispensed from the container.

18. The method of claim 16, wherein the closure plug has a sealing diameter sealed to a corresponding portion of the internal surface of the container neck and having a reduced diameter corresponding to the indicator.

19. The method of claim 16, wherein the indicator circumscribes a portion of the closure plug.

* * * * *